United States Patent [19]

Graham

[11] 4,015,516

[45] Apr. 5, 1977

[54] PLUG PAD INSERTING APPARATUS FOR CARTON FORMING MACHINES

[75] Inventor: Robert H. Graham, Spokane, Wash.

[73] Assignee: R. A. Pearson Company, Spokane, Wash.

[22] Filed: Feb. 13, 1976

[21] Appl. No.: 657,844

[52] U.S. Cl. ..... 93/36.3; 93/36.01; 93/59 ES

[51] Int. Cl.[2] ..... B31B 7/00

[58] Field of Search ..... 93/36.3, 39 R, 55, 36 R, 93/59 R, 59 ES, 36.01, 46, 50, 37 R; 229/23 A

[56] References Cited

UNITED STATES PATENTS

| | | | |
|---|---|---|---|
| 2,713,812 | 7/1955 | Mischke | 93/36 R |
| 2,879,700 | 3/1959 | Richardson et al. | 93/37 R |
| 3,038,387 | 6/1962 | Pearson | 93/37 R |
| 3,134,308 | 5/1964 | Ali-Oglu | 93/36.3 X |
| 3,421,415 | 1/1969 | Pearson | 93/36.3 |
| 3,780,627 | 12/1973 | Roda | 93/37 R |

*Primary Examiner*—James F. Coan
*Attorney, Agent, or Firm*—Wells, St. John & Roberts

[57] ABSTRACT

An apparatus for inserting a plug pad into a recess formed between opposed bottom flaps of a semirigid folded carton. The pad inserting apparatus is designed to be utilized in conjunction with a carton forming machine. It can be integral with the forming machine or separate from it. It includes a magazine for receiving and supporting a horizontal stack of plug pads. A biasing assembly is utilized to force the stack toward a magazine discharge end. Adjacent the discharge end is a pad stripping mechanism. It operates to take pads one at a time from the magazine and move them to a remote mandrel loading station to be received by a movable mandrel. The pads toward the inside end of the stack are elevationally offset by an inclined surface as they are indexed toward the pad stripping mechanism. The stripping mechanism further includes a positioning feature whereby the end pad is first moved laterally of the remainder of the stack to a preselected position before being shifted to the loading station. This is done as the pad previously located at the inside end of the stack is moved to the mandrel loading station. The mandrel is operated to move the successive pads into the open end of a waiting container. A pad ejecting mechanism is included on the mandrel that is responsive to engagement of the mandrel with a carton bottom to force a pad forwardly into the recess between flaps along the carton bottom.

16 Claims, 10 Drawing Figures

FIG 1
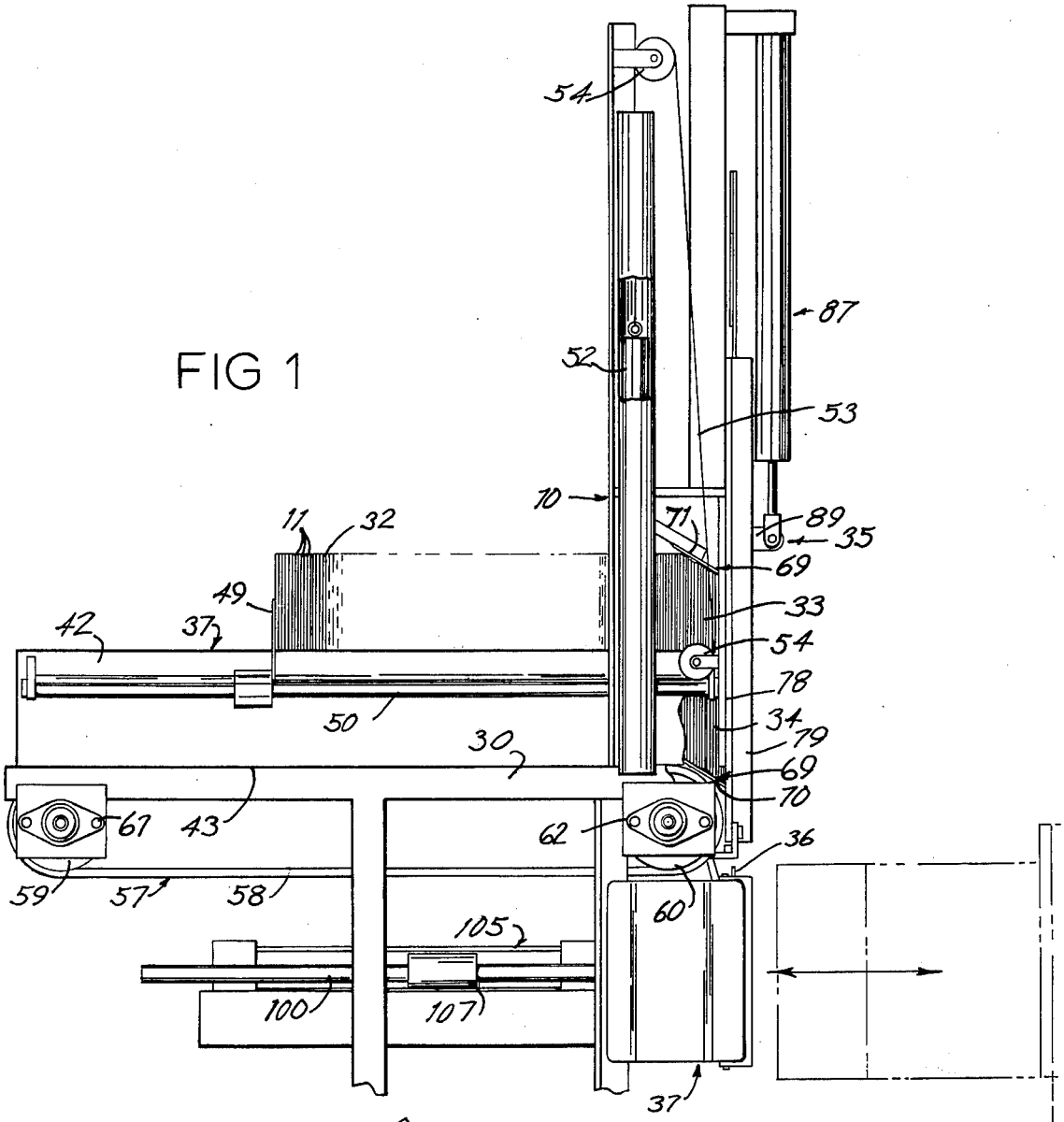
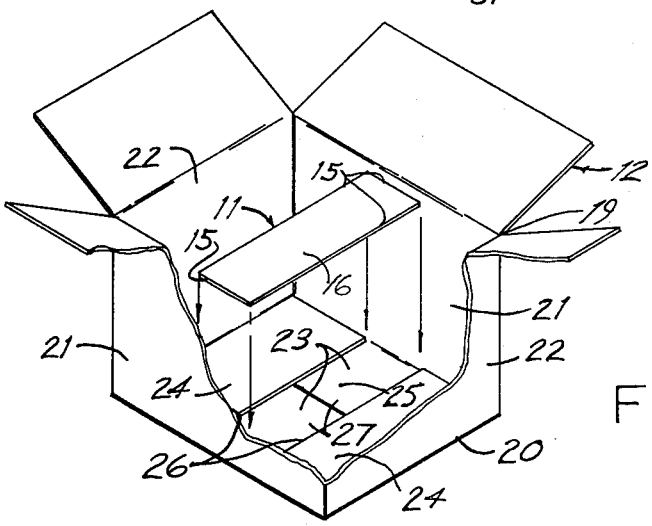
FIG 2

FIG 3
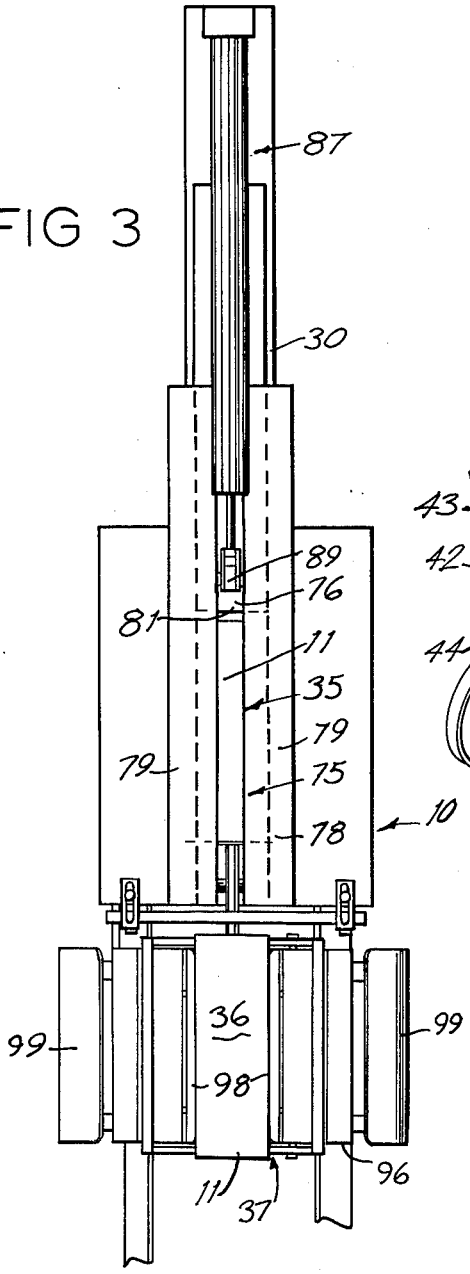
FIG 4
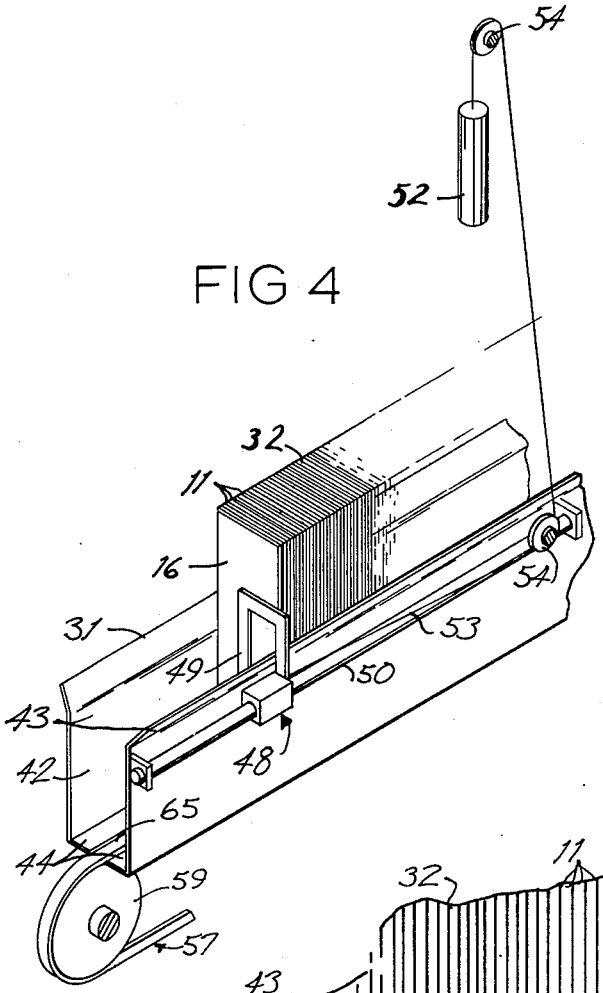
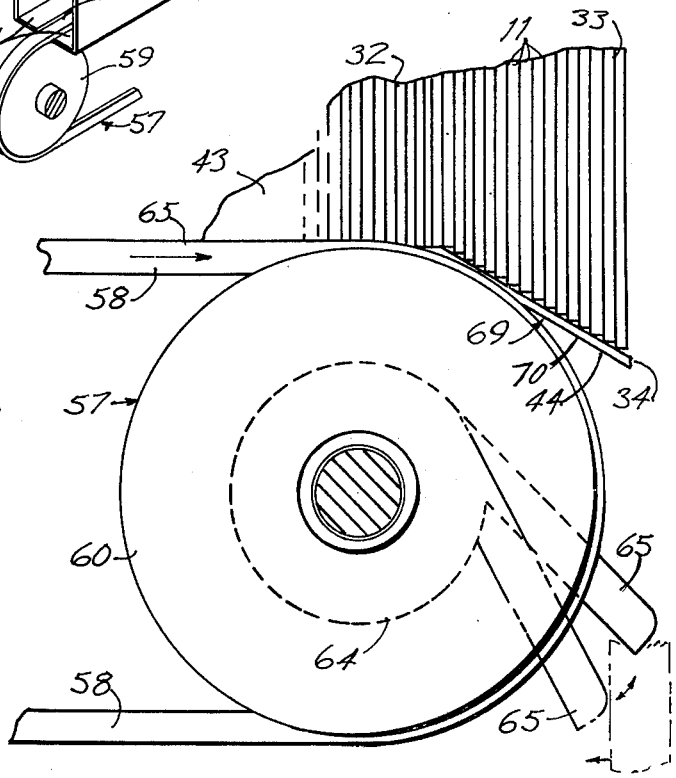
FIG 5

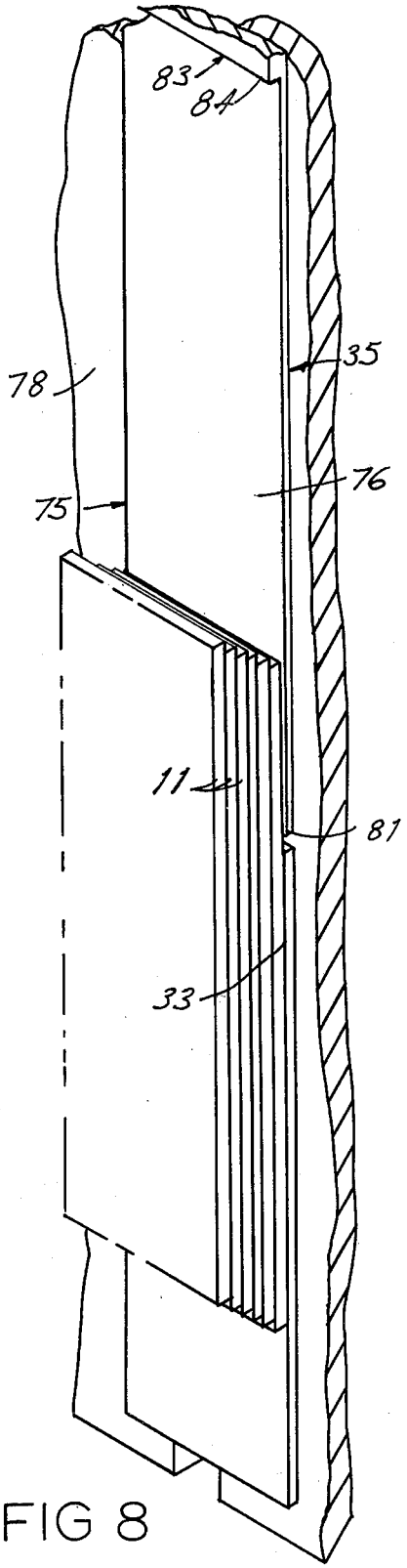
FIG 8
FIG 9
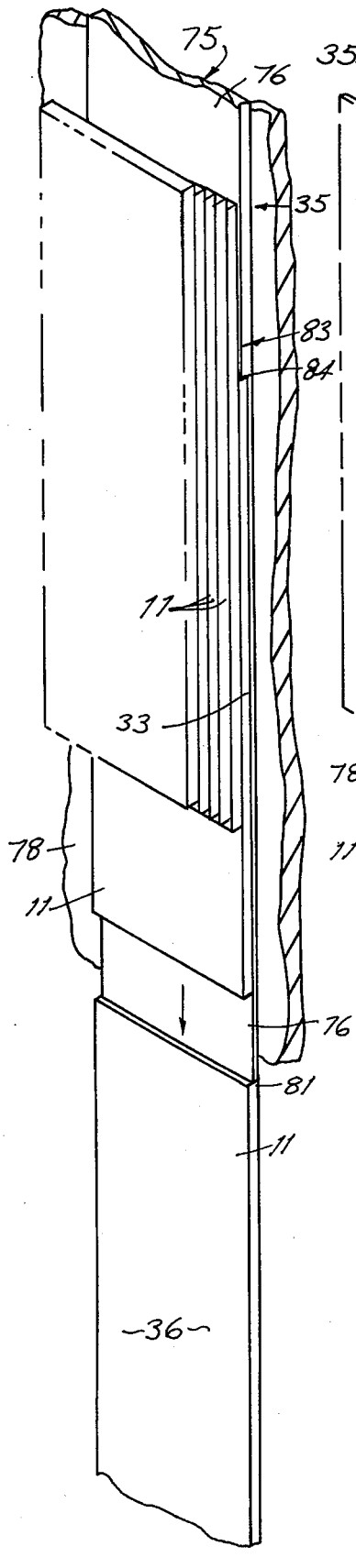
FIG 10
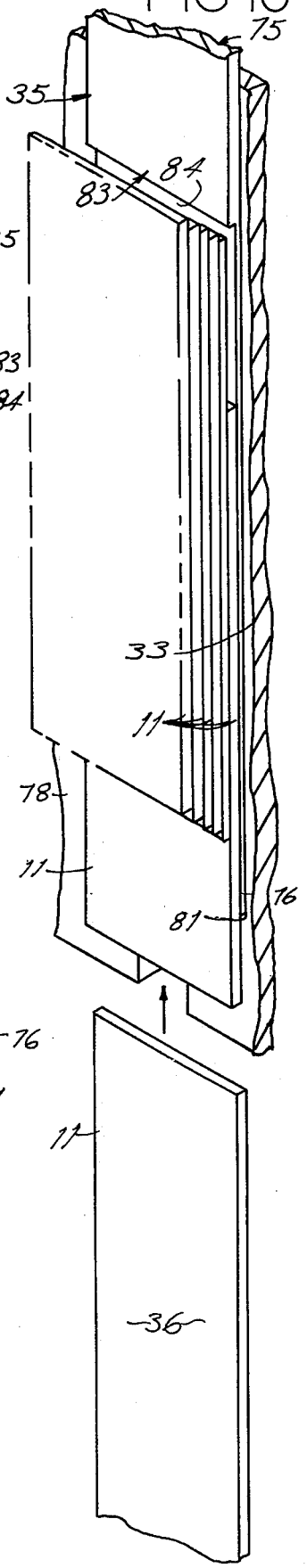

PLUG PAD INSERTING APPARATUS FOR CARTON FORMING MACHINES

BACKGROUND OF THE INVENTION

The present invention is related to apparatus for forming cartons and more particularly to such devices utilized to insert a plug pad into the recess formed between opposed end flaps of a semi-rigid folded carton.

It is often desirable in the packing industry to utilize a form of carton that includes a flat floor surface. Known forms of cartons include folded bottom flaps that touch along their outward edges so as to form a continuous flat surface along the carton bottom. Such cartons are, however, expensive to purchase.

A less expensive form of carton utilizes folded flaps wherein the edges do not touch but instead leave a slight recess in the otherwise planar bottom surface. It is perferable to have the shortened flaps on the inside of such cartons to avoid catching exposed edges. Such cartons are considerably less expensive than those having longer flaps. It has, therefore, become desirable to provide some mechanism for inserting a filler or plug pad into that recess in order that the carton bottom be planar between the upright side walls.

The present invention was designed to automatically place a plug pad into a recess between bottom flaps of a carton while the carton itself is being formed or subsequent to carton formation. This is accomplished by providing a magazine for receiving a stack of plug pads, a stripping mechanism for moving single pads laterally of the stack and inserting them into a mandrel at a mandrel loading station. By moving the individual pads and mandrel into the open end of a carton, the plug pad is pressed into the complementary recess in the bottom of the carton.

I have found it to be more economical to provide an apparatus to place plug pads between shortened carton flaps rather than to simply purchase cartons that include flaps that may be folded to obtain a planar carton bottom. Furthermore such an apparatus may be mounted downstream from a carton former or can be incorporated into existing carton forming machines without decreasing the efficiency of the machine or requiring substantial modifications thereof.

SUMMARY OF THE INVENTION

A plug pad inserting apparatus is described for inserting a carton bottom plug pad into a carton of the type formed of folded semi-rigid panels such as cardboard. Such a carton includes an open top and closed bottom. The carton further includes upright peripheral side and end walls. The bottom end is formed by end flaps and side flaps that are folded across one another in adjacent planes and glued together between the side and end walls. A recess, opening toward the top end of the carton, is defined by edges of the end flaps, the side walls, and the inwardly facing surfaces of the side flaps. The plug pads themselves include peripheral edges defined by parallel oppositely facing planar side surfaces and are equal in dimension to the carton recesses. The inserting apparatus is comprised of a magazine means that receives a stack of plug pads and includes an open discharge end for releasing individual pads therefrom. A mandrel means is also provided for receiving single pads from the magazine means at a mandrel loading station. Pad placing means is utilized for feeding successive pads from the magazine means to the mandrel means at the mandrel loading station. A mandrel drive means moves the mandrel into the open end of a carton to press against the closed carton bottom. An ejection means is utilized at this point to remove a single pad from the mandrel and press the pad into the carton recess.

It is the primary object of the present invention to provide an apparatus for modifying cartons having shortened end flaps so they may be utilized in place of cartons having continuous planar bottoms.

Another object is to provide such an apparatus that may be utilized with existing carton forming machinery.

A still further object is to provide such an apparatus that is simple in construction and thereby relatively maintenance free.

Still further objects and advantages will become apparent upon reading the following description which, taken with the accompanying drawings, disclose a preferred form of the present invention. It is to be understood however that the following description and attached drawings are only exemplary of a single form of the present machine. Only the appended claims are to be taken as definitions and restrictions upon the scope of the present invention.

BRIEF DESCRIPTION OF THE DRAWINGS

FIG. 1 is a side elevational view of the present apparatus;

FIG. 2 is a pictorial view broken away partially to show the type of carton and plug pad to be utilized in conjunction with the present invention;

FIG. 3 is a front elevational view as seen from the right in FIG. 1;

FIG. 4 is a fragmentary diagrammatic view illustrating functional details of a pad biasing means;

FIG. 5 is an enlarged fragmentary sectional view illustrating another biasing means and a plug pad offsetting means;

FIGS. 8 through 10 are diagrammatic sequence views illustrating operation of a pad stripping mechanism.

DETAILED DESCRIPTION OF A PREFERRED EMBODIMENT

Figure 6:
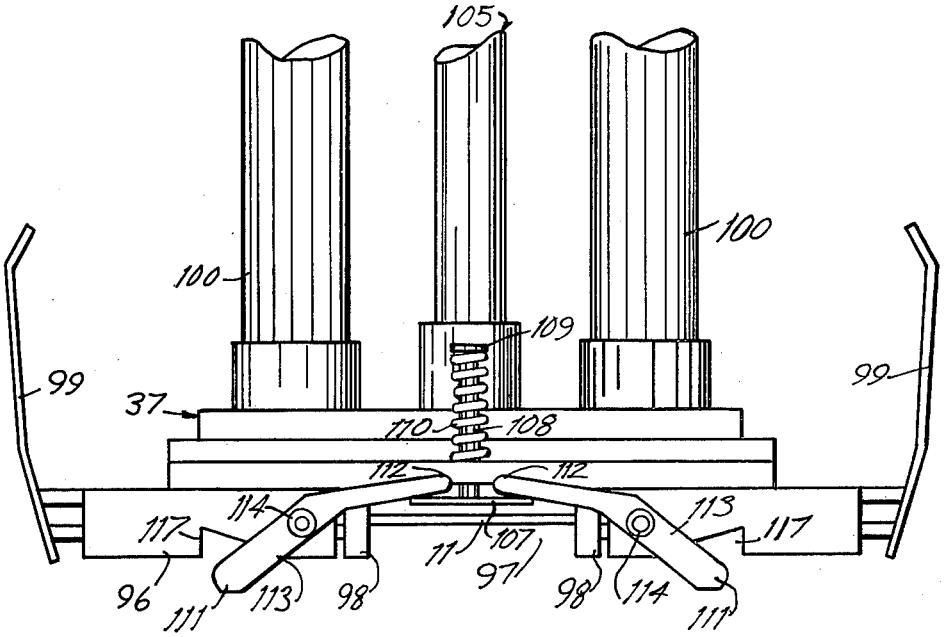
FIG. 6 is an enlarged fragmentary view of the mandrel utilized with the present invention.

The plug pad inserting apparatus is illustrated in the accompanying drawings by FIGS. 1 and 3. The apparatus is generally designated in these figures by the reference character 10. It is intended that this apparatus be utilized in conjunction with a carton forming machine such as that disclosed in U.S. Pat. No. 3,421,415. The present apparatus may be entirely separate from the forming machine or may be included as an integral part of the forming machine, replacing the existing bottom forming mandrel. In the latter arrangement, the apparatus would assist in the carton forming operation as well as a plug pad inserting operation. Otherwise, the apparatus is used to insert a single pad 11 into complementary recesses formed within folded successive cartons 12.

FIG. 2 illustrates a plug pad 11 and a carton 12 of the type to be utilized in conjunction with the present invention. Pads 11 simply comprise a rectangular piece of material such as cardboard. They may be formed of the same material utilized to construct carton 12. Each pad 11 includes peripheral side edges 15 and oppositely facing planar surfaces 16.

Carton 12 is formed of cardboard or other semirigid material by folding a single piece of precut material. Such a carton typically includes an open top end 19 and a closed bottom 20. Between top and bottom 19 and 20 extend vertical side walls 21 and end walls 22. The bottom 20 is formed by side wall flaps 23 and end wall flaps 24. Flaps 23 and 24 are folded inwardly and glued together along their planar surfaces.

The dimensions of end flaps 24 are not such that the entire bottom surface is covered when they are folded inwardly. Therefore, a recess 25 remains. This recess is defined by end flap edges 26, inwardly facing surfaces 27 of side flaps 23, and side walls 21. The pads 11 are cut to conform precisely to the dimensions of recess 25 so they are sufficiently thick between surfaces 16 to fill the recesses and connect the flaps 24 in a single plane.

The present apparatus 10 includes a supportive framework 30 that may be self supported or adapted to be mounted on a carton forming machine. Framework 30 mounts a magazine means 31. Magazine 31 is utilized to receive a horizontally oriented stack 32 of plug pads 11. The stack is received by magazine 31 with the plug pad surfaces 16 in a vertical orientation. A forwardly facing inside stack end 33 is adjacent an open discharge end 34 of magazine 31.

A pad placing means 35 is also mounted to framework 30. It functions at magazine discharge end 34 to remove successive pads from forward stack end 33 and to move the successive pads laterally from the stack to a mandrel loading station 36.

A movable mandrel means 37 is located at mandrel loading station 36 to receive successive plug pads from pad placing means 35. A mandrel drive means 38 functions to move mandrel means 37 forward and backwardly. At a forward position, the mandrel is received within the open top end of a carton and presses against the closed bottom end. The retracted position is shown in FIG. 1 wherein the mandrel is located adjacent the loading station 36.

An ejection means is provided on mandrel means 37 that functions in response to engagement of the mandrel means with a carton bottom. As the mandrel means engages the carton bottom, the ejection means operates to press a plug pad into the aligned carton recess 25.

The magazine means 31 may be seen in greater detail with reference to FIGS. 1 and 4. Magazine means 31 includes a hopper 42 formed of upright sides 43 and a horizontal floor 44. Hopper 42 is upwardly open to receive stack 32. An open forward end of hopper 42 defines magazine discharge end 34.

Because hopper 42 is oriented horizontally, a mechanical biasing means 48 is provided to continuously urge the stack 32 forwardly toward the magazine discharge end. Biasing means 48 includes a push plate 49. Plate 49 is slidably mounted on a longitudinal slide bar 50. The push plate 49 extends upwardly from bar 50 then over and into the hopper where it engages the rearward end of stack 32. Push plate 49 is continuously urged toward the forward end of hopper 42 by a counterweight 52.

Counterweight 52 is supported by a cord 53 and pulleys 54. Cord 53 is connected to weight 52 at one end and to push plate 49 at an opposite end. Pulleys 54 rotatably receive the cord 53 and movably guide it from weight 52 to plate 49. Counterweight 52 is slidably held within an upright tube 55. Weight 52, as long as it is suspended by cord 53, will produce a pulling force against plate 49 to urge stack 32 toward the magazine discharge.

In addition to biasing means 48, there is provided an intermittent biasing means 57. Biasing means 57 is included to assure that the upright relationship of the pads within stack 32 is maintained while the stack is moved toward the hopper forward end. As implied, biasing means 57 is operated intermittently. It functions in response to movement of the mandrel means 37.

Biasing means 57 is illustrated in substantial detail by FIG. 5 of the drawings. Means 57 includes an endless belt 58 whose course is defined by an idler pulley 59 and a drive pulley 60. Pulleys 59 and 60 are rotatably carried on framework 30 by bearings 61 and 62 respectively.

A free wheeling one-way clutch 64 is mounted to a shaft carrying the drive pulley 60. Clutch 64 is operated by a forwardly extending arm 65 that is engaged and moved rearwardly (dashed lines FIG. 5) by the mandrel means 37. The arm is fixed to the clutch so as the arm pivots backwardly, the clutch will engage and turn the drive pulley 60 in a clockwise direction (indicated by the arrow in FIG. 5).

Intermittent motion of drive pulley 60 is transmitted to belt 58. A working flight 65 of belt 58 is positioned within a longitudinal slot 67 in floor 44. Working flight 65 is engagable with and partially supports the stack 32. Therefore, when pulley 60 is indexed by clutch 64, the stack 32 is also indexed forwardly.

A pad offsetting means 69 is illustrated in FIGS. 1 and 5 of the drawings. Offsetting means 69 is utilized to elevationally step the pads at the forward end of stack 32 so that their upper horizontal edges are spaced slightly apart. Means 69 includes an inclined surface 70 of floor 44 and an inclined parallel guide 71 spaced upwardly from surface 70.

Surfaces 70 and 71 are parallel to one another and arranged at an oblique angle with the surfaces 16 of pads 11. The angle of surfaces 70 and 71 determines the offset distance between adjacent horizontal edges of successive pads 11. It is only intended to offset pad edges a slight distance so they are not coplanar with the remaining edges of pads with the stack 32. The successive edges are exposed on different elevational planes to discourage binding together of two or more adjacent plugs when operated on by placing means 35.

The purpose of magazine means 31 is to deliver successive pads 11 to be acted upon by pad placing means 35. Means 35 is illustrated in FIGS. 1, 3 and schematically in FIGS. 8 through 10. Pad placing means 35 is utilized to move individual pads from the stack end to the mandrel loading station 36. The stack end, mandrel loading station 36, and placing means 35 all are located within a vertical plane.

Pad placing means 35 is comprised of a pad stripping means 75. Means 75 includes a vertical plate 76 that is slidably mounted along an upright abutment surface 78 of framework 30. Surface 78 is stationary and situated at the forward stack end and discharge of magazine means 31. Abutment surface 78 serves to halt forward progression of the stack as urged by means 48 and 57. Forward progression of the stack is made only as individual pads are removed from the forward stack end.

Once this happens, the stack is free to index forwardly, bringing the next successive pad into engagement with plate 78.

Plate 76 is slidably carried within vertical guide ways 79. Ways 79 are mounted to abutment surface 78 to direct plate 76 vertically across the point of engagement between the forward stack end and abutment surface 78.

Plate 76 includes a pad engaging edge 81 that serves to engage successive pads along their upper horizontal edges. Thickness of plate 76 at edge 81 is less than the corresponding thickness of pads 11. Therefore, the edge 81 can slip between abutment surface and the next pad in line from the end pad before it engages the edge of the end pad (FIG. 8).

A lateral positioning means 83 is provided to further offset the end pad from the remaining pads at the end of stack 32. Means 83 is comprised of a pad edge engaging shoulder 84 on plate 76 equal in dimension to edge 81. This shoulder 84 is located rearwardly of edge 81 and is spaced elevationally therefrom by a distance greater than the height of a single pad. Shoulder 84 may be provided by mounting a separate plate to plate 76. By doing so, the shoulder may be adjustably positioned on plate 76 to facilitate operation upon pads of different size.

A cylinder means 87 interconnects framework 30 with plate 76. Cylinder means 87 is vertical, with one end connected to plate 76 by a bracket 89 provided thereon. A cylinder mounting bracket on framework 30 mounts the opposite cylinder end. Extension of cylinder means 87 results in downward movement of plate 76 and corresponding engagement of edge 81 and the inner end pad of the stack. Continued downward movement moves the end pad downwardly to the mandrel loading station where it is received by mandrel means 37.

As the end pad is being pushed downwardly by pad engaging edge 81 the shoulder 84 moves into engagement with the next successive pad. This pad then becomes the inward end of the stack as the previous end pad becomes engaged by mandrel means 37. While this is happening, the new end pad is moved downwardly to its offset position by shoulder 84 (FIG. 9).

Figure 7:
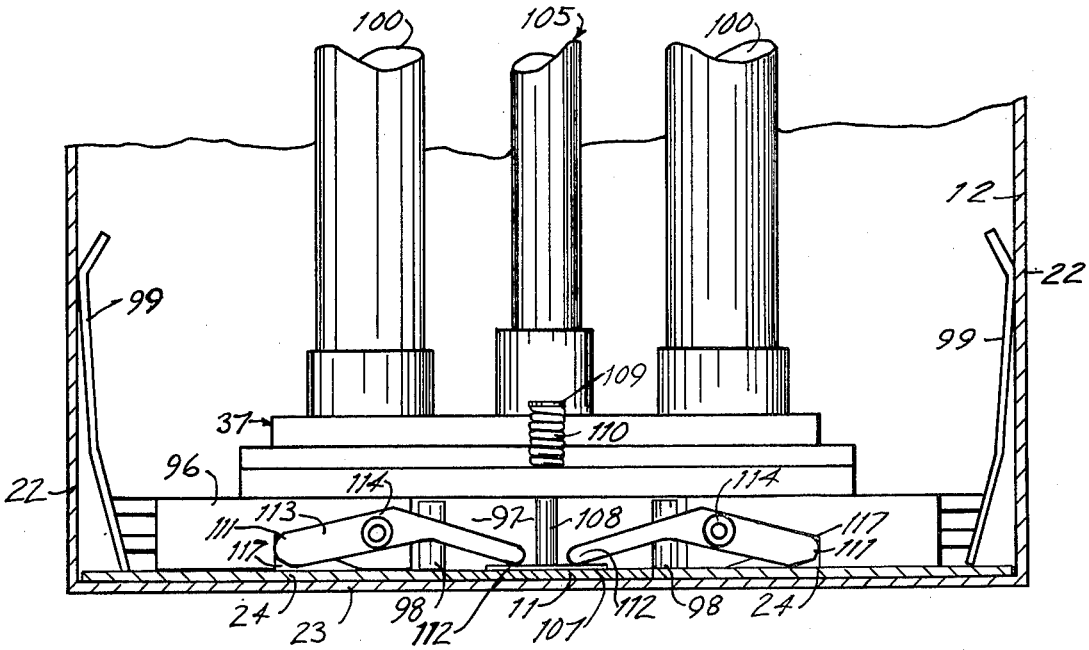
FIG. 7 is a view similar to FIG. 6 only showing the mandrel in position with a carton and also showing operation of pad ejection means.

The mandrel means 37 is illustrated in substantial detail in FIGS. 3, 6 and 7. Mandrel means 37 includes an upright plate 96 having a forwardly facing rectangular recess 97. Recess 97 receives successive pads from pad placing means 35 at mandrel loading station 36.

Upright sides of recess 97 are defined by pad receiving spring clamps 98. These clamps 98 are biased toward one another across the recess 97 by springs (not shown). As shown in FIG. 3, the upper ends of clamps 98 are curved so they will be cammed outwardly as the successive pads are forced downwardly therebetween. The clamp plates are smooth across their pad engaging surfaces to allow forward movement of the pads in response to the ejector means 39.

Mandrel plate 96 mounts guide plates 99 that project outward and rearwardly from the mandrel plate ends. The purpose for plates 99 is to center a carton relative to the mandrel means. These plates are adjustable inward and outwardly to accommodate cartons of different size.

In operation, the mandrel is inserted into the open end of a carton and the plates 99 engage the carton side walls. If the carton is slightly off center from the mandrel, guide plates will automatically shift the carton on its support to accurately align the carton recess 25 with the pad held by the spring clamps 98.

Plate 96 is held for translational forward and backward movement by a pair of guide rods 100. Rods 100 are slidably held with appropriate bushings 101 that are in turn affixed to framework 30. The translational path for mandrel means 37 is defined by the guide rods and bushings to be parallel to the direction of movement of the stack 32 within magazine means 31.

Movement of mandrel means 37 is accomplished by means of a cylinder 105. Cylinder 105 is mounted to framework 30 between the guide rods 100. The piston end of cylinder 105 is fixed to plate 96 at its approximate center so as to prevent binding between guide rods 100 and bushings 101. The cylinder piston is extendable to move the mandrel means into engagement with the bottom of a container. Retraction of the piston moves mandrel 37 back to the mandrel loading station.

Pad ejection means 39 is mounted to mandrel means 37 for operation in response to engagement of the mandrel with a carton bottom. It is the purpose of ejection means 39 to force a pad from engagement by the mandrel means into an aligned recess 25 of a carton 12.

Ejection means 39 includes a plate 107 that is movably mounted within the recess 97. Plate 107 is mounted by horizontal rods 108 that extend through appropriate openings in the mandrel plate 96. Caps 109 are provided at the ends of rods 108 to retain a pair of compression springs 110. The springs 110 serve to continuously urge plate 107 toward a rearward position in the recess as shown in FIG. 6.

The bias of springs 110 is overcome by a pair of lever arms 113 pivotably mounted to plate 96 and operatively engaging the ejection plate 107. Levers 113 are mounted between ends to plate 96 by pivot pins 114. Inwardly spaced from pivots 114 are inside lever ends 112 that slidably engage a rearward side of plate 107. Outer ends 111 of levers 113 are urged by springs (not shown) to normally project forwardly from plate 96 for operative engagement against the bottom closed end of a carton. Recesses 117 are provided in plate 96 to receive inwardly pivoted lever ends 111 when engaged against a carton bottom.

The function of ejection means 39 is best illustrated in FIG. 7. As the mandrel means is moved forwardly into the open end of a waiting container, the forwardly projecting lever ends 111 come into contact with the carton bottom. Continued forward movement of the mandrel pivots the levers 113 to bring the inside ends 112 forward and outside ends 111 backward. Forward movement of inside ends 112 results in corresponding forward movement of plate 107. Plate 107 engages and forces a pad held within mandrel plate recess 97 outward of the mandrel and into the complementary carton recess 25.

Prior to operation, the present apparatus is attached to or operatively associated with a carton forming machine or other means by which cartons may be delivered to a preselected location forward of the mandrel means 37. It is typical of such machines to deliver the cartons with their open ends facing sideways as is shown by dashed lines in FIG. 1. However, some machines also discharge formed cartons with the open top end facing upwardly. In such a situation, it would be a matter of simply changing the orientation of certain elements such as the counterweight assembly to adapt the present apparatus for functioning in an upright position.

It is also noted that the machine may be adaptable to receive and operate upon plug pads 11 of different configuration and size. Therefore, the hopper walls 42 may be adjustably mounted to framework 30. The walls may then be separated or brought together according to the complementary width of the plug pads presently being handled. Further, the pad placing means 35 may be modified equally as easily to accommodate pads of different size without departing from the basic principals and mode of operation of the present invention.

During operation, a stack of pads is placed within the hopper 42. In doing this, the operator pulls the push plate 49 rearwardly and holds it while the stack is being placed within the hopper. Once the stack is in place, he then releases the push plate to move forwardly and engage the rearward pad in the stack. Forward bias of the plate 49 urges the stack forwardly toward the magazine discharge end to bring the forwardmost pad into abutment with the abutment plate 78.

The pad presently engaging abutment plate 78 is in alignment with and coplanar to the pad stripping plate 76 and the recess 97 of mandrel means 37. Appropriate switching (not shown) may serve to actuate the cylinder 87 when a carton is received in position of alignment with mandrel means 37.

Upon such actuation, the cylinder will extend to bring plate 76 downwardly to engage the forward pad with pad engaging edge 81. The elevational space between edges of adjacent pads at the forward end of the stack decrease possibilities that the edge 81 will engage and move any more pads than the one forward end pad downwardly to mandrel means 37.

As plate 76 and the forward pad move downwardly, shoulder 84 comes into engagement with the next successive pad. Shoulder 84 moves this pad downwardly to a lowered elevation from the remainder of the stepped pads at the forward stack end. This assures that frictional engagement between the forward pad and the upwardly moving plate 76 will not result in corresponding upward movement of this pad above the remainder of the stack.

Downward movement of plate 76 moves the pad presently at the forward end of stack 32 into engagement between the spring clamps 98. These clamps 98 hold the pad in alignment with a waiting recess 25 of a carton 12. Further, these clamps 98 hold the pad in this position while the mandrel means is moved forwardly into the open end of the carton. However, when lever ends 111 come into contact with the carton bottom, the inside ends 15 pivot forwardly to push plate 107 and the pad into the waiting recess.

Previous gluing or glue application operations assure that the pad will adhere to the surfaces bordering the recess. Once the pad is in place, the mandrel will return to the position wherein recess 97 is located at the mandrel loading station to receive the next successive pad at forward end of stack 32. The completed container may then move on for further handling and the next successive container is moved into its place. This operation may be performed continuously and automatically so long as cartons and pads are supplied to the apparatus.

It is again stressed that the above description and attached drawings are given only as one example of a preferred form of the present invention. It is well understood that changes and modifications may be made therein without departure from the intended scope of this invention. Therefore, only the following claims place restrictions upon and define the present invention.

What I claim is:

1. A plug pad inserting apparatus for inserting a carton bottom plug pad into a pre-formed or partially formed carton of the type including folded semi-rigid panels such as cardboard and including:

A. an open top end;

B. upright peripheral side and end walls;

C. a bottom end that when complete is formed by:

a. end flaps folded inwardly across the bottom end from the end walls with inward end flap edges spaced apart by a prescribed distance;

b. side flaps folded inwardly across the bottom end overlapping the end flaps and including inside edges spaced closely adjacent one another;

c. a recess opening toward the top end and defined by the end flap edges, side walls, and surfaces of the side flaps that face the top end;

wherein the plug pad includes peripheral edges defined by parallel oppositely facing planar side surfaces and is equal in dimension to the recess and wherein the plug pad inserting apparatus is comprised of:

a supportive framework;

a magazine means for receiving a stack of plug pads, and having an open discharge end for releasing individual pads;

mandrel means for receiving single pads from the magazine means at a mandrel loading station;

pad placing means for feeding successive pads to the mandrel means at the mandrel loading station;

mandrel drive means for moving the mandrel into the open end of a carton to press against the carton bottom; and ejection means for removing the single pad from the mandrel and pressing the pad into the recess.

2. The apparatus as defined by claim 1 wherein the pad placing means is comprised of a pad stripping means for removing single pads from an inner end of the stack at the magazine discharge end and for moving the individual removed pads to the mandrel loading station.

3. The apparatus as defined by claim 2 wherein the mandrel loading station is laterally disposed from the inner end of the stack and wherein the pad stripping means operates in a plane including the inner stack end and the loading station.

4. The apparatus as defined in claim 1 further including means for offsetting adjacent pads in the stack comprised of a guide and support surface at the magazine discharge end that is inclined at an oblique angle to the planar surfaces of the pads in the stack.

5. The apparatus as defined by claim 1 further comprises:

biasing means for continuously urging the stack toward the magazine discharge end.

6. The apparatus as defined by claim 5 further comprising intermittent biasing means operative in response to operation of the mandrel means to index the stack toward the magazine discharge and to supplement the continuous force supplied by the continuous biasing means.

7. The apparatus as defined by claim 1 further comprising intermittent biasing means operative in response to operation of the mandrel means to index the stack toward the magazine discharge end.

8. The apparatus as defined by claim 3 wherein the pad placing means also includes means for laterally positioning a successive pad at a selected position while the stripping means removes the pad previously located at the hopper discharge end.

9. The apparatus as defined by claim 8 wherein the pad placing means comprises:

a plate having planar side surfaces parallel to the planar surfaces of the pads; and a pad edge engaging shoulder located on a plate surface facing the stack.

10. The apparatus as defined by claim 9 further comprising cylinder means attached to the plate for sliding the plate across the stack at the hopper discharge end to engage the end pad of the stack and move it laterally to the mandrel and wherein the edge engaging shoulder is positioned to engage the next successive pad and move it laterally to the selected position as the end pad is being received by the mandrel.

11. The apparatus as defined by claim 1 wherein the mandrel means includes an open pad receiving recess and the pad ejection means operates in response to pressing of the mandrel means against the closed bottom of a carton to press a pad into a carton recess from the mandrel pad receiving recess.

12. The apparatus as defined by claim 11 further comprising cylinder means for moving the mandrel translationally from a pad receiving position to a pad ejecting position inside an aligned carton.

13. The apparatus as defined by claim 5 further comprising abutment means spaced forward of the magazine discharge end to obstruct forward movement of the stack as urged by the biasing means.

14. The apparatus as defined by claim 13 wherein the mandrel loading station is laterally disposed from the inner end of the stack and wherein the pad placing means operates in a plane including the inner stack end and the loading station.

15. The apparatus as defined by claim 13 wherein the abutment means is located slightly forward of the pad placing means in order to align the end pad with the pad placing means.

16. The apparatus as defined by claim 11 wherein the ejection means is comprised of:

a plate member movably mounted to the mandrel within the pad receiving recess;

a guide rod mounting the plate to the mandrel to guide forward and rearward movement thereof within the pad receiving recess;

biasing means interconnecting the guide rod and mandrel for urging the plate backward;

a lever arm pivotably mounted to the mandrel and including one end projecting forward of the mandrel and a remaining end engaging the plate along a rearwardly facing side, and wherein the lever arm is pivoted at a point between the arm ends.

* * * * *